United States Patent [19]

Denton

[11] Patent Number: 5,039,065

[45] Date of Patent: Aug. 13, 1991

[54] FENCE APPARATUS

[76] Inventor: M. John Denton, 4200 Norwood Ave., Trenton, Mich. 48183

[21] Appl. No.: 558,719

[22] Filed: Jul. 27, 1990

[51] Int. Cl.[5] ..... E04H 17/06

[52] U.S. Cl. ..... 256/1; 256/32

[58] Field of Search ..... 256/32, 33, 20, 1; 47/33; 52/102; 404/7, 8

[56] References Cited

U.S. PATENT DOCUMENTS

| | | | |
|---|---|---|---|
| 2,713,751 | 7/1955 | Hendrixson | 47/33 |
| 3,277,606 | 10/1966 | Cohen | 47/33 |
| 3,378,949 | 4/1968 | Dorris | 47/33 |
| 3,384,351 | 5/1968 | Turner, Jr. | 256/32 |
| 3,515,373 | 6/1970 | Abbe | 256/32 |
| 3,545,127 | 12/1970 | Jensen | 256/32 X |
| 3,704,004 | 11/1972 | Carter, Jr. | 47/32 X |
| 3,713,624 | 1/1973 | Niemann | 256/32 |
| 3,768,780 | 10/1973 | Cowles et al. | 256/32 X |
| 3,806,096 | 4/1974 | Eccleston et al. | 256/32 |
| 3,822,864 | 7/1974 | Keys | 256/32 |
| 3,945,747 | 3/1976 | Cruz | 256/32 X |
| 4,349,989 | 9/1982 | Snider, Jr. | 256/32 X |
| 4,478,391 | 10/1984 | Kovach | 256/32 X |
| 4,497,472 | 2/1985 | Johnson | 256/32 |
| 4,515,349 | 5/1985 | Groves | 256/32 |
| 4,548,388 | 10/1985 | Cobler | 256/32 |
| 4,595,175 | 6/1986 | Kauffman et al. | 256/32 X |
| 4,903,947 | 2/1990 | Groves | 256/32 |
| 4,907,783 | 3/1990 | Fisk et al. | 256/32 |

*Primary Examiner*—Andrew V. Kundrat
*Assistant Examiner*—Franco S. De Liguori
*Attorney, Agent, or Firm*—Dykema Gossett

[57] ABSTRACT

A fence apparatus is disclosed for use in conjunction with an existing fence or in combination with the construction of a new fence. The fence apparatus of the preferred embodiment of this invention has a flexible planar member to which two flexible members are attached. The two flexible members may be moved from an insertable planar position to an operative extended position such that the two flexible members occupy opposite sides of a typical fence and are secured thereto. The fence apparatus of the preferred embodiment of this invention prevents the growth of grass and/or other types of vegetation underneath and in close proximity to the fence and also prevents the growth of grass and/or other vegetation underneath the apparatus itself.

4 Claims, 3 Drawing Sheets

FENCE APPARATUS

1. FIELD OF THE INVENTION

This invention relates to a fence apparatus, and more particularly, to a fence apparatus which may be used with a pre-existing fence or as part of a new installation of a fence, and which substantially eliminates the growth of grass and/or other vegetation underneath of and in close proximity to the fence.

2. DISCUSSION

Many types of fence devices have been used in order to eliminate the growth of grass and/or other various types of vegetation, underneath of and in close proximity to a fence. The elimination of such grass and/or other vegetation has been desired in order to reduce the time and effort associated with the trimming or cutting of such grass and/or other vegetation and to maintain a pleasant appearance of the fence area. While many of these devices have been somewhat successful in meeting these general objectives, these devices have found to have significant difficulties associated therewith.

That is, many of these existing fence devices are incapable of being used with pre-existing fences since these devices are not readily insertable underneath of the pre-existing fence and are therefore incapable of preventing the growth of grass and/or other types of vegetation from underneath these pre-existing fences. Additionally, grass and/or other types of vegetation have been found to grow underneath of these pre-existing fence devices themselves, causing an unsightly appearance and the expenditure of much time and effort in the removal of this growth. Additionally, many of these existing fence devices are not capable of conforming to the various curvatures of the fence structure to which they are coupled, causing the creation of various openings in which grass and/or other types of vegetation may grow. Further, many of these existing fence devices have been relatively expensive, relatively cumbersome and difficult in their installation.

SUMMARY OF THE INVENTION

It is, therefore, a primary object of this invention to provide a fence apparatus which may be readily used with an existing fence and in conjunction with the new installation of a fence.

It is another object of this invention to provide a fence apparatus which may be readily insertable underneath a fence and which may be readily configurable to the various structural contours of the fence.

It is a further object of this invention to provide a fence apparatus which substantially eliminates the growth of grass and/or other vegetation from underneath and in close proximity to the fence.

According to the teachings of the present invention, a fence apparatus may be constructed having a flexible base planar member coupled to two other flexible side members. The flexible side members are movable between a folded position and an operative extended position. The fence apparatus of the preferred embodiment of this invention may be readily inserted underneath of a pre-existing fence when the flexible side members are folded over the base planar member. Thereafter, the flexible side members are placed into the extended operative position such that the members are made to contact opposite sides of the fence. A pin or other suitable coupling device may then be inserted through mating holes along both side members in order to secure the side members to the fence. The fence apparatus of the preferred embodiment of this invention substantially eliminates the growth of grass and/or other vegetation in close proximity to the fence and substantially prevents the growth of grass and/or other vegetation from underneath of the device. The fence apparatus of this invention is flexible and readily adaptable to the variations in the contours of the fence, thereby substantially preventing the creation of openings in which grass or other types of vegetation may grow.

Further objects, features and advantages of the invention will become apparent from the consideration of the following description and the appended claims when taken in connection with the accompanying drawings.

BRIEF DESCRIPTION OF THE DRAWINGS

Various advantages of the present invention will become apparent to those skilled in the art by reading the following specification in reference to the following drawings in which.

DETAILED DESCRIPTION OF THE INVENTION

Figure 1:
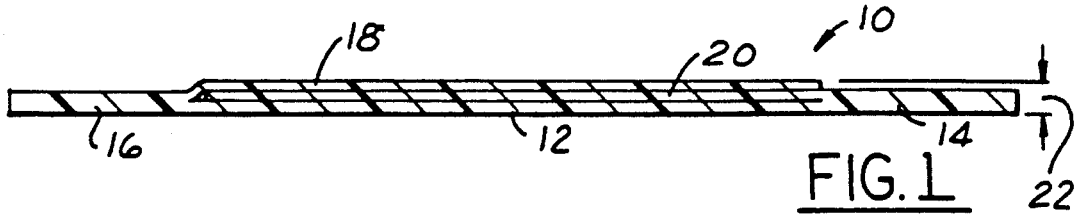
FIG. 1 is a sectional view of the fence apparatus made in accordance with the teachings of the preferred embodiment of this invention, shown in an insertable planar position.
Figure 2:
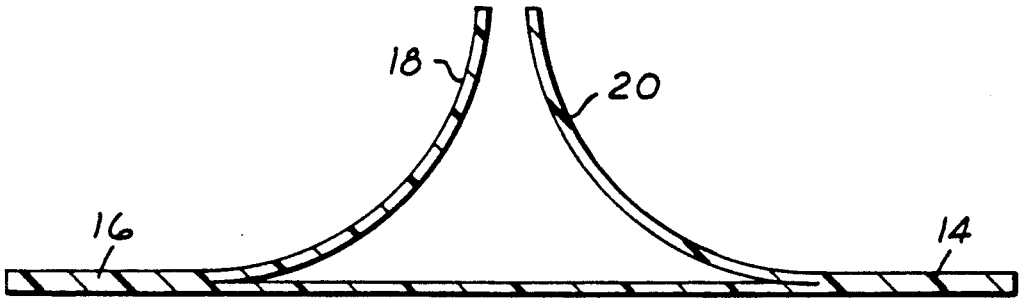
FIG. 2 is a sectional view of the fence apparatus made in accordance with the teachings of the preferred embodiment of this invention, shown in a raised and operative position.

Referring to FIG. 1, there is shown a fence apparatus 10 made in accordance with the teachings of the preferred embodiment of this invention and having a flexible base planar member 12, defining track portions 14 and 16. Apparatus 10 further has flexible side members 18 and 20 which are coupled to the flexible base member 12. Ideally, apparatus 10 is created by a typical extrusion, injection, welding, or casting processes such that members 12, 14, and 16 are be formed of rubber, plastic, or like material. In this manner, apparatus 10 may be made to easily bend in order to be inserted underneath of a fence and members 18 and 20 may be made to adapt to the changing contours of the shape of the fence, to which apparatus 10 is coupled. Additionally, the flexibility of members 18 and 20 allows these members to be movable between a folded insertable position, as shown in FIG. 1, and an operative extended position as shown in FIG. 2. The flexibility of members 18 and 20 also allows apparatus 10, when placed in an insertable position, to have a relatively small thickness 22 associated therewith. This relatively small thickness 22, further allows apparatus 10 to be readily inserted underneath of a pre-existing fence.

Figure 6:
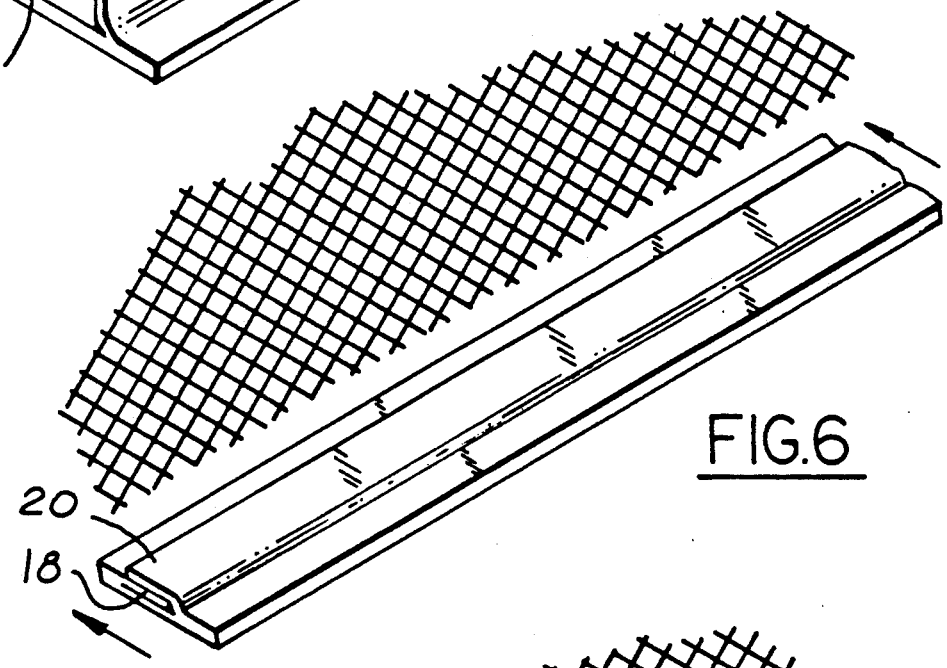
FIG. 6 is an illustration of the fence apparatus of the preferred embodiment of this invention, shown in an insertable planar position prior to assembly with a typical fence.

The installation of the fence apparatus 10 to a pre-existing fence is shown with respect to FIGS. 1, 2 ,6, and 7. Specifically, apparatus 10 is initially placed into a planar insertable position, shown in FIGS. 1 and 6, by the folding of flexible side members 18 and 20 over base planar member 12. Apparatus 10 is then inserted underneath the pre-existing fence 24 such that members 18 and 20 occupy opposite sides of the fence 24, as shown in FIG. 6. The relative ease of installation is due to the relatively small thickness 22 associated with apparatus 10, when apparatus 10 is placed into an insertable position.

Figure 7:
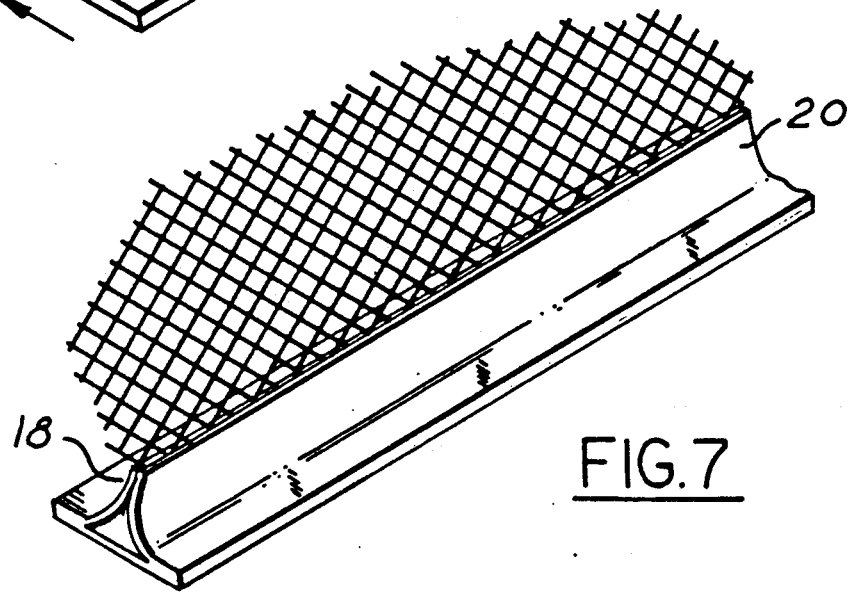
FIG. 7 is an illustration of the fence apparatus of the preferred embodiment of this invention, shown in assembly relation with a typical fence.

Upon the placement of the apparatus 10 underneath the fence 24, members 18 and 20 are then raised into an operative extended position of FIGS. 2 and 7 such that members 18 and 20 are made to contact opposite sides of fence 24, as shown in FIG. 7. Thereafter, apparatus 10 may be secured to fence 24 by the use of many typical securing techniques. In this manner, base planar member 12 covers any existing grass and/or other vegetation that is currently growing underneath of or in close proximity to the fence 24. By covering this existing grass and/or vegetation, base planar member 12 prevents the reception of sunlight and moisture by this grass and/or vegetation which results in the destruction of this existing grass and/or vegetation and in the prevention of any new growth of such grass and/or vegetation in the covered areas. Therefore, not only does base planar member 12 prevent the growth of grass and/or vegetation from underneath of the fence 24 or in close proximity thereto, but also prevents the growth of grass and/or vegetation from underneath apparatus 10.

Figure 3:
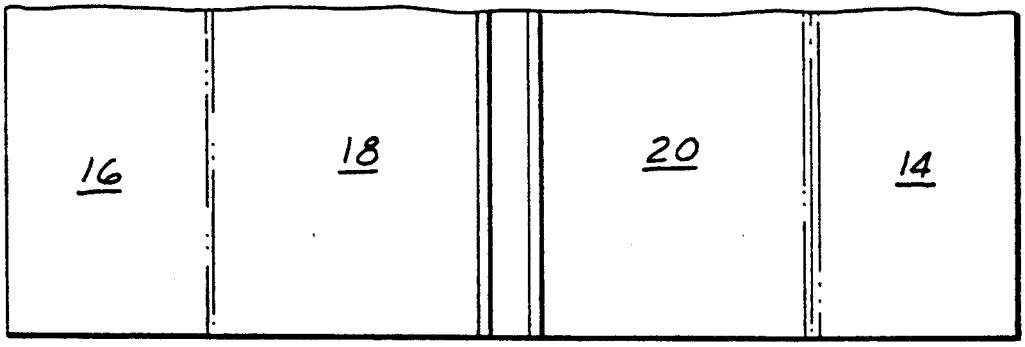
FIG. 3 is a top view of the fence apparatus shown in FIG. 2.

Additionally, while apparatus 10 is in the extended operative position shown in FIGS. 2, 3, and 7, track portions 14 and 16 provide a convenient track upon which the wheels of a typical lawn cutting device may ride when cutting grass and/or other vegetation in close proximity to these track portions 14 and 16. Additionally, track portions 14 and 16 cooperate with flexible side members 18 and 20 to protect the fence 24 from contact with the typical lawn cutting device and therefore prevent substantially any damage to fence 24 by the same.

Figure 4:
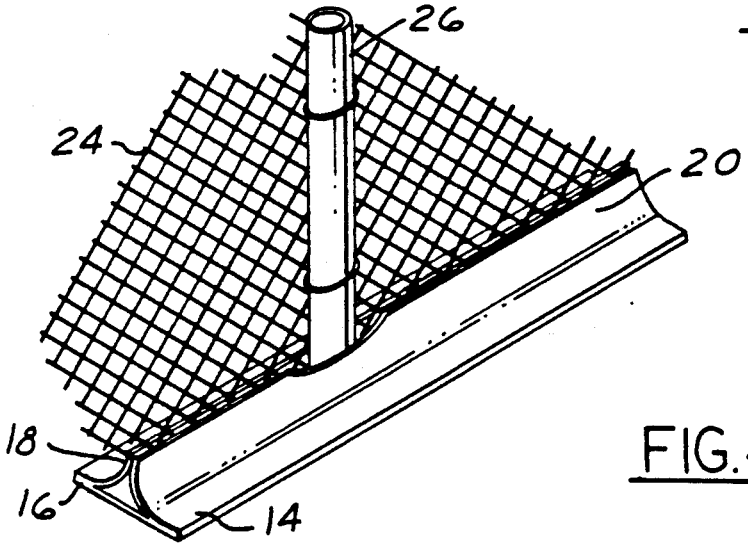
FIG. 4 is the fence apparatus made in accordance with the teachings of the preferred embodiment of this invention, shown in an assembly relation with a typical fence having a fence post disposed along one side thereof.

Flexible side members 18 and 20 are pliable such that members 18 and 20 may be bent to conform to the changing shape of the fence 24 and are capable of being tightly coupled to a typical fence post 26 which resides along one side of the fence 24, as shown in FIG. 4. That is, fence post 26 is received by one of the flexible side members 18 or 20 such that the flexible side member 18 or 20 is bent around the fence post 26. Such bending of flexible side member 18 does not allow, in any manner, the grass and/or other vegetation which is underneath of or in close proximity to fence 24 to receive sunlight and/or moisture. This is due to the fact that the grass and/or other vegetation which may be underneath of or in close proximity to fence 24 is covered by base portion 12, even after the flexible side member 18 or 20 is bent in the manner shown in FIG. 4.

Figure 9:
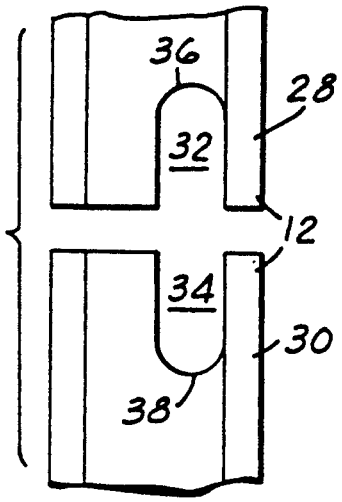
FIG. 9 is sectional view of the base planar member of the fence apparatus made in accordance with the teachings of the preferred embodiment of this invention, illustrating the modification of the base planar member to receive a typical fence post disposed along one side thereof.

In order for base portion 12 to receive fence post 26 and to continue to adequately cover the area underneath of and in close proximity to the fence 24, base portion 12 must be modified in the manner shown in FIG. 9. That is, base portion 12 is cut along the full width thereof at a point past contact with fence post 26. This cutting of base portion 12 results in the formation of two end portions 28 and 30. Each end portion 28 and 30 is then modified to define complementary semicircular areas 32 and 34 respectively. These areas 32 and 34 cooperate so as to receive fence post 26 and completely encircle the same. Areas 32 and 34 maintain contact with fence post 26 along respective edges 36 and 38 associated therewith, in order to tightly couple the fence post 26 to the base planar portion 12 so that sunlight and moisture is prevented from being received by any grass and/or other types of vegetation that may lie underneath of base planar portion 12, in close proximity to the fence post 26.

Figure 8:
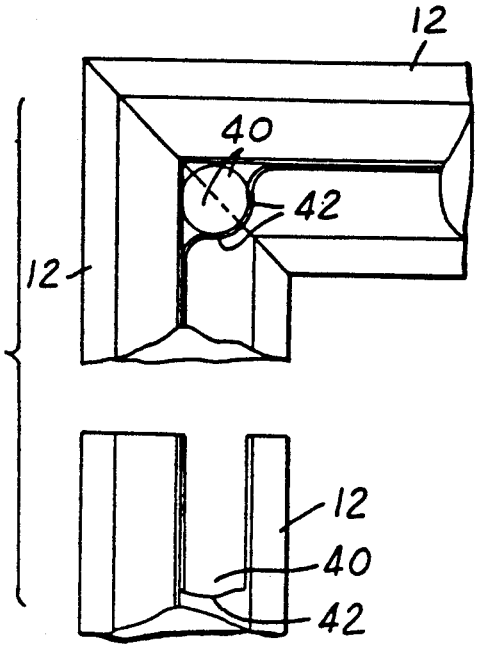
FIG. 8 is a sectional view of the base planar member of the fence apparatus made in accordance with the teachings of the preferred embodiment of this invention, illustrating the modification of the base planar member to receive a typical corner fence post.

In the event that fence post 26 is positioned at a typical corner of the fence 24, base portion 12 is modified in the manner illustrated in FIG. 8. That is, base portion 12 is cut along the full width thereof and a semi-circular area 40 is made to be defined thereby. Semi-circular area 40 is defined so as to encircle a portion of the circumference of the fence post 26 such that edge portion 42 of area 40 always remains in contact with the fence post 26. This tight coupling of area 40 with the corner fence post 26 prevents sunlight and/or moisture from being received by the grass and/or other vegetation which is present underneath of base portion 12, in close proximity to the corner fence post 26. The other portion of the corner fence post 26, that is not in contact with edge portion 42 of area 40, may be encircled by another base planar member 12 (not shown) that is coupled to a side of the fence 24 which is perpendicular to the side shown in FIG. 4.

Figure 5:
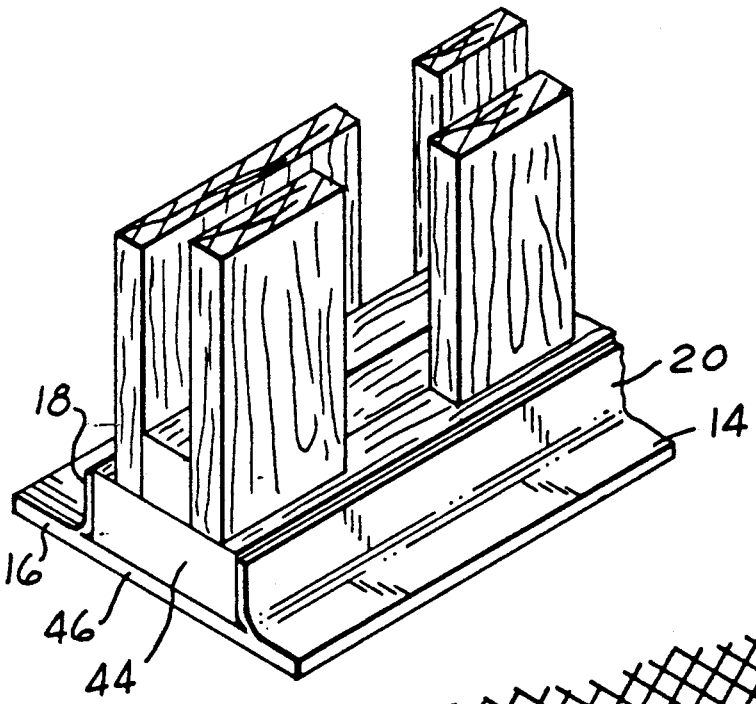
FIG. 5 is an illustration of the fence apparatus of the preferred embodiment of this invention, shown in assembly relation with a typical wooden fence.

Referring now to FIG. 5, there is shown a typical wooden fence 44 to which the fence apparatus 10, of the preferred embodiment of this invention is attached. If the fence 44 is pre-existing and if the bottom portion thereof 46 is separated from the ground by a distance greater than width 22, than apparatus 10 may be inserted underneath of fence 44 in the manner earlier described. However, if the fence 44 is being newly installed than the apparatus 10 may be moved to the extended operative position, shown in FIGS. 2 and 7 and base planar portion 12 may he made to receive the bottom portion 46 of fence 44. Thereafter, flexible side members 18 and 20 may be secured to the fence 44 by any of a plurality of typical methods. It should be apparent to one of ordinary skill in the art, that apparatus 10 may be utilized with a plurality of different types of fences including, but not limited to the fences 24 and 44 disclosed herein.

Figure 10:
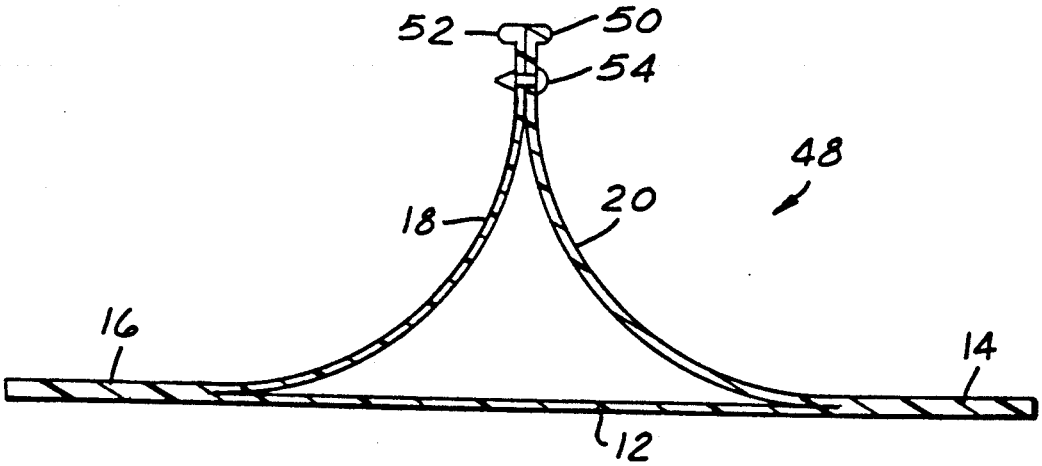
FIG. 10 is a second embodiment of the fence apparatus made in accordance with the teachings of this invention.

Referring now to FIG. 10, there is shown a second embodiment 48 of the invention and having a base planar member 12 which defines track portions 14 and 16 and which further has flexible side members 18 and 20 coupled to the base planar portion 12. The members 12, 18, and 20 are substantially similar to the members 12, 18, and 20 of the first embodiment of this invention as shown in FIGS. 1-9. However, the apparatus 48, of the second embodiment of this invention, includes stiffener ribs 50 and 52, disposed upon the upper portion of members 18 and 20 respectively and which extend across the full length of the individual members 18 and 20 and which further protrude therefrom. Such stiffener ribs 50 and 52 are made to contact opposite sides of typical fence 24 and cooperate to further secure apparatus 48 to the fence 24. Additionally, apparatus 48 has periodically spaced holes along members 18 and 20 to receive coupling device, i.e., pins 54 or other means. Pin 54 acts to further couple apparatus 48 to fence 24.

It is also understood that the invention is not limited to the exact construction or method illustrated and described above, but that various changes and modifications may be made without departing from the spirit and scope of the invention as defined in the following claims.

I claim:

1. A fence apparatus for installing on an existing fence, said apparatus comprising:

first means, movable between an insertable planar position and an operative extended position, for insertion underneath a fence and for preventing growth of grass in close proximity to a first side of said fence;

second means coupled to said first means and movable between an insertable planar position, in which said second means overlays said first means, and an operative extended position for insertion underneath a fence and for preventing growth of grass in close proximity to a second side of said fence; and ground engaging planar base means for providing a track upon which wheels of a lawn cutting device traverse; said first means comprising a first flexible side member coupled to a first end of said ground engaging planar base means and effective to protect said first side of said fence from contact with said lawn cutting device; said second means comprising a second flexible side member coupled to a second end opposite said first end of said group engaging planar base means; said ground engaging planar base means being positioned underneath and perpendicular to said fence and extending between said first and second ends from said first flexible member to said second flexible member.

2. The fence apparatus of claim 1 wherein said first flexible side member includes a stiffener rib protruding therefrom.

3. An apparatus for installation on an existing fence, said apparatus comprising:

ground engaging planar base means slidably positioned underneath of and perpendicular to said fence;

a first flexible member, coupled to said ground engaging planar base means at one end of said first flexible member and movable between a folded planar position and an operative extending position in which a second end of said first flexible member engages a first side of said fence;

a second flexible member, coupled to said ground engaging planar base means at one end of said second flexible member and movable between a folded planar position in which said second flexible member overlays said first flexible member and an operative extending position in which a second end of said second flexible member engages a second side of said fence, said second side of said fence being opposite said first side of said fence; said ground engaging planar base means extending from said one end of said first flexible member to said one end of said second flexible member and securing means coupled to said first and to said second flexible members for securing said first and said second flexible members to said fence.

4. A fence apparatus for installation on an existing fence, said apparatus comprising:

a ground engaging flat base positioned underneath of and perpendicular to said fence and having a first planar portion outwardly extending from a first side of said base, and a second planar portion outwardly extending from a second side opposite said first side of said base, said first and said second planar portions each defining a track upon which wheels of a lawn cutting device may ride;

first flexible flap means movably coupled at one end to said first planar portion and movable from a first position in which said first flap overlays said base to a raised fence contacting position effective to protect one side of said fence from contact with said lawn cutting device;

second flexible flap means movably coupled to one end to said second planar portion and movable from a first position in which said second flap overlays said first flap to a raised fence contacting position effective to protect a second side of said fence from contact with said lawn cutting device;

whereby said apparatus is initially inserted in a gap between the ground and the lower edge of said fence, with said first and second flexible flap members each in said first position, and thereafter said first and second flexible flap members being moved to their respective fence contacting positions, with said flat base lying on the ground surface beneath the fence to prevent grass from growing thereunder.

* * * * *